United States Patent [19]

Okamoto et al.

[11] Patent Number: 4,585,319

[45] Date of Patent: Apr. 29, 1986

[54] RECORDING APPARATUS FOR ELECTROSTATIC IMAGES

[75] Inventors: Yukio Okamoto; Kiyoshi Kimura; Tadashi Miwa; Noriyoshi Tarumi; Masakazu Fukuchi; Kunio Ito, all of Hachioji, Japan

[73] Assignee: Konishiroku Photo Industry Co., Ltd., Tokyo, Japan

[21] Appl. No.: 555,453

[22] Filed: Nov. 28, 1983

[30] Foreign Application Priority Data

Nov. 29, 1982 [JP] Japan ..... 57-210480

[51] Int. Cl.[4] ..... G03G 15/12

[52] U.S. Cl. ..... 355/3 R; 355/3 FU; 355/30

[58] Field of Search ..... 355/3 R, 3 FU, 3 TR, 355/30; 219/216

[56] References Cited

U.S. PATENT DOCUMENTS

| | | | |
|---|---|---|---|
| 4,161,357 | 7/1979 | Herman et al. | 355/30 X |
| 4,163,892 | 8/1979 | Komatsu et al. | 219/216 |
| 4,319,828 | 3/1982 | Komori et al. | 355/30 X |
| 4,341,455 | 7/1982 | Fedder | 355/3 TR |
| 4,367,036 | 1/1983 | Sakamaki et al. | 355/30 X |

*Primary Examiner*—R. L. Moses

*Attorney, Agent, or Firm*—Jordan B. Bierman

[57] ABSTRACT

A recording apparatus for electrostatic images comprising a photoreceptor, an intermediate transfer substance and a means for heating toner images transferred onto said intermediate transfer substance and transferring again and fixing them onto a transfer material, characterized in that there are provided a means for detecting a temperature of aforesaid photoreceptor and a means for keeping the temperature of said photoreceptor within a fixed range of $T_1$ through $T_2$.

6 Claims, 6 Drawing Figures

RECORDING APPARATUS FOR ELECTROSTATIC IMAGES

BACKGROUND OF THE INVENTION

1. Field of the Invention

The present invention relates to a recording apparatus for electrostatic images having therein a means for maintaining the temperature of a photoreceptor within a certain range.

2. Description of the prior art

Specific characters of a photoreceptor to be used in a recording apparatus for electrostatic images such as a charging voltage characteristic, dark voltage and others may change according to the temperature of the photoreceptor and a photosensitivity thereof also increases as the temperature of the photoreceptor rises. Accordingly, when the temperature of the photoreceptor is excessively low, the so-called grey background phenomenon wherein toner adheres to the background of the image takes place and when the temperature of the photoreceptor is excessively high, the image density is lowered, which adversely affects the quality of the recorded material.

In the recording apparatus for electrostatic images in the practical use, there exist many factors affecting the temperature of the photoreceptor such as electric parts of every kind provided in the case thereof or the heat generated from the heat roller for image-fixing and others and therefore it is important to avoid such effect. Especially in the recording apparatus for electrostatic images of the type disclosed in Japanese Patent Publication Open to Public Inspection No. 78559/1974 for example wherein toner images formed on the photoreceptor that is the subject of the present invention are contacted and transferred onto the heated intermediate transferring material and the toner in the molten state is further transferred again and fixed onto the final support such as a paper and thus the recorded materials are obtained, the temperature fluctuation on the photoreceptor tends to be great because the heated intermediate transferring substance contacts the photoreceptor directly thus the quality of the recorded material varies remarkably between the moment right after the start of the apparatus and the moment after a long waiting period or between the moment of the start of continuous recording in many sheets and the moment of the completion thereof, which sometimes causes difficulties in the practical use.

As a method to prevent the quality fluctuation on the recorded material based on the temperature fluctuation on the photoreceptor mentioned above, there have been proposed the methods to detect the change in the surface potential on the photoreceptor or the change in the electrostatic contrast on the electrostatic latent image formed on the photoreceptor depend on the temperature fluctuation and thereby automatically adjust the conditions in each step of charging, exposure and developing. However, all these methods require the addition of the detector for the voltage-measurement and complicated devices such as the computing circuit and control circuit for the automatic control for the steps of charging, exposure and developing. Further, the aforesaid adjustment for each step cannot compensate fully and it is almost impossible to obtain an image quality of a certain high grade.

SUMMARY OF THE INVENTION

It is an object of the present invention to provide, without an application of the complicated means as mentioned above but with an addition of a relatively simple device, a recording apparatus for electrostatic images that is not affected by the conditions of ambient temperature and the time elapsed from the start and is capable of obtaining recorded materials having a stable quality.

Aforesaid object is attained by the recording apparatus for electrostatic images being equipped with a device comprising a means for detecting the temperature of the photoreceptor a means for keeping the temperature of aforesaid photoreceptor within a certain range of $T_1$ through $T_2$, a means for heating the photoreceptor up to a fixed temperature of $T_1$ and a means for cooling the photoconductive photosensitive substance, wherein aforesaid cooling means operates when the temperature of the photoreceptor reaches a fixed temperature of $T_2$.

DETAILED DESCRIPTION OF THE INVENTION

Figure 1:
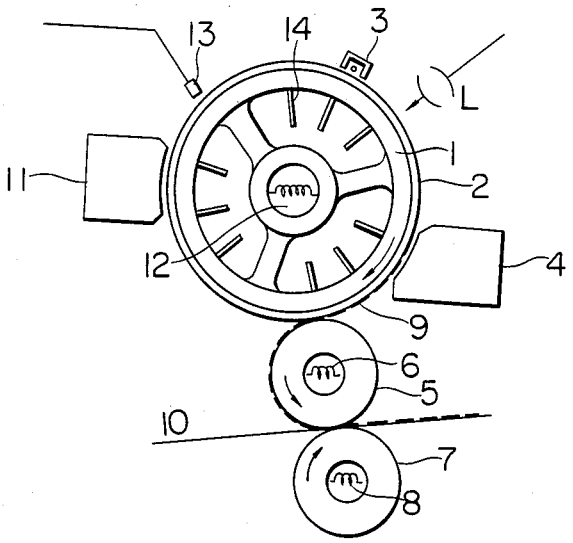
FIG. 1 is a schematic illustration of a recording apparatus which constitues the present invention.

The present invention will be explained in detail as follows referring to the drawings.

FIG. 1 shows an example of the state of operation of the recording apparatus for electrostatic images having the constitution of the present invention.

Figure 2:
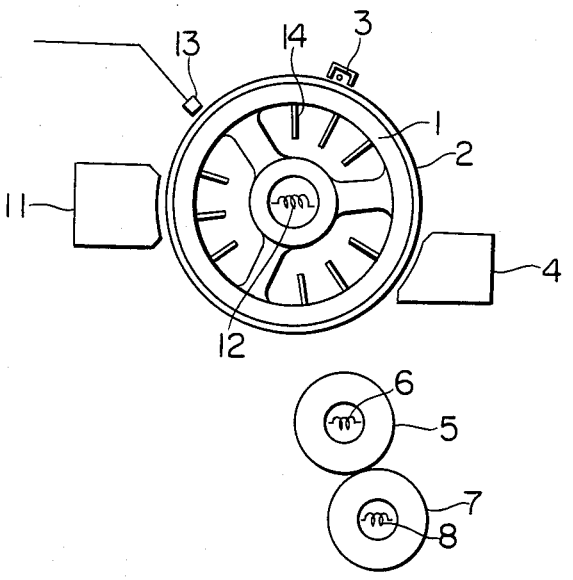
FIG. 2 is a schematic illustration of the recording apparatus in idling condition of the copy machine.

The numeral 1 is a photoreceptor-supporting drum whose surface is coated with a photosensitive substance 2 and it rotates in the direction of an arrow. The numeral 3 is a charging electrode, 4 is a developing unit, 5 is an intermediate transfer roller with a surface thereof having a pertinent adhesiveness against the toner and the heater 6 heats the intermediate transfer roller up to several tens degrees centigrade through one hundred and several tens degrees centigrade. The numeral 7 is a transfer fixing roller and it is heated by the heater 8 up to the temperature slightly higher than that of the intermediate transfer toller of the example. The photoreceptor 2 is given a charge by the charging electrode 3 and is exposed by the light image formed through the lens L and then is toner-developed by the developing unit 4. The toner image 9 formed through the development is transferred onto the intermediate transfer roller 5 and then is heated thereon to become a melted state and then is transferred again and fixed onto the recording material 10 by means of a transfer-fixing roller, thus the recorded material is finished. The surface of the photosensitive substance 2 from which the image has been transferred is cleaned by the cleaning device 11 and advances again to the charging step to be used repeatedly. During the period of suspension of the apparatus or the apparatus is in a stand-by position, the intermediate transfer roller 5 is kept apart from the surface of the photosensitive substance 2, as shown in FIG. 2, to avoid the partial overheat on the photosensitive substance 2.

Figure 3:
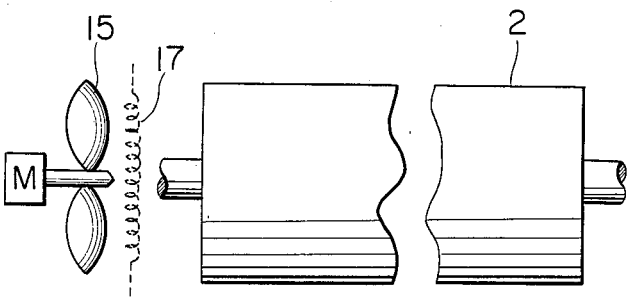
FIG. 3 is a schematic illustration showing an example of the device wherein the fan blows air against the side of the photoreceptor.

In an apparatus having no special device, when the power source is cut and the apparatus is kept in suspension for a long time, the temperature of the photoreceptor is the same as the room temperature. After the power source switch is turned on, the heater 6 and the heater 8 operate and thereby the rollers 5 and 7 are heated to become a stand-by state but the temperature of the photoreceptor 2 still is at the level which is close to the room temperature. If the operation of the apparatus is not started, the heated intermediate transfer roller contacts the surface of the photoreceptor and thereby the temperature thereof rises quickly and reaches several tens degrees centigrade after continuing large amounts of copying operation. As the temperature goes up, the performance of the photoreceptor changes remarkably and the quality of the recorded material to be obtained becomes unstable considerably. To avoid this, the heater 12 is provided in the rotating shaft of the drum 1 in the apparatus of the present invention as a means for heating the photoreceptor 2 and the apparatus is so constituted that the heater 12 is supplied power after the main power source switch is turned on and thereby the photoreceptor 2 is heated, during the stand-by period (idling condition), up to the fixed temperature of $T_1$ at which a specific character of the photoreceptor 2 becomes stable. This heater for heating the photoreceptor may be located inside the drum 1 for example or located near the surface of the photoreceptor as shown in FIG. 3, without being limited to the aforesaid position. Further, as another means, it is possible to make the heated intermediate transfer roller 5 contact the photoreceptor 2 like in the period of operation, without providing the heater in particular, and make both of them rotate thus heat the photoreceptor. The temperature of the photoreceptor is detected by the temperature detector 13 and when the temperature reaches the fixed temperature of $T_1$, the signal produced therefrom discontinues the heating by cutting the power source for the heater 12 or by separating the intermediate transfer roller 5 from the photoreceptor 2, and when the temperature of the photoreceptor 2 becomes lower than $T_1$, the heater 12 or the intermediate transfer roller 5 is put in the heating state again and thus the repetition of such steps can keep the temperature at the fixed value of $T_1$.

As a temperature detecting means to be used for the present invention, a thermocouple, thermistor, a thermometric platinum resistance, a temperature-sensitive magnetic material and a bimetal may be used and these may be arranged near the photoreceptor or may be arranged so that they come into contact with the photoreceptor.

With aforesaid device, the temperature of the photoreceptor in the stand-by state is constantly kept at the fixed temperature of $T_1$ or higher than that and the quality deterioration of the recorded material such as the occurrence of grey background caused by the low temperature of the photoreceptor at the start of operation can be prevented.

Figure 4:
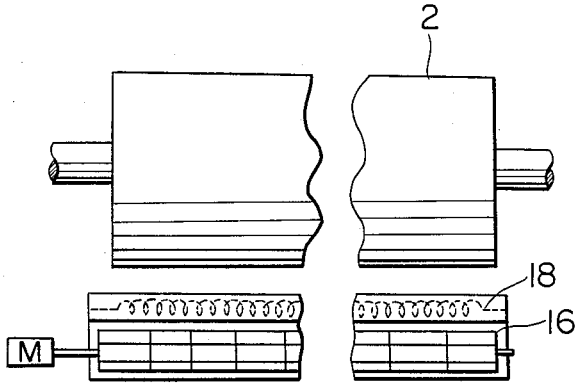
FIG. 4 shows an example of device wherein the sirocco type fan blows air against the surface of the photoreceptor.

As a cooling means for preventing the overheat of the photoreceptor under continuous copying operation, on the other hand, there is provided a ventilation fan that blows air against the side or the surface of the photoreceptor as shown in FIG. 3 or FIG. 4 and is started by aforesaid temperature detecting means when the temperature of the photoreceptor reaches the fixed temperature of $T_2$, and is stopped when the temperature becomes lower than $T_2$. Owing to this, the temperature of the photoreceptor may be kept at $T_2$ or lower than that even for the continuous operation.

FIG. 3 shows an example of the device wherein the fan 15 blows air against the side of the photoreceptor for cooling or heating and FIG. 4 shows an example of the device wherein the sirocco type fan 16 blows air against the surface of aforesaid photoreceptor. As the air for cooling, the ones in the case of the electrostatic recording apparatus may be used repeatedly but the low temperature air outside of the case is more preferable to be used than the air inside the case.

To increase the cooling effect, it is possible to provide radioator fin indicating numeral 14 in FIG. 1 on the inner surface of drum 1. Further, it is possible to provide heaters 17 and 18 in the ventilation path as shown with broken lines in the figure and use them as aforesaid heating means for photoreceptor.

The temperature $T_2$ at which the cooling is started is set within a range so that $T_2$ is higher than aforesaid $T_1$ and the quality of the recorded material obtained at photosensitive substance temperature of $T_2$ is practically the same as that of recorded material obtained at the temperature of $T_1$.

Thus the temperature of the photoreceptor is kept within a range from $T_1$ to $T_2$ during the period of operation and thereby the recorded materials with a certain level of quality are constantly obtained.

As a photoreceptor for the present invention, all sorts of photosensitive substances such as selenium photosensitive substance, amorphous silicon photosensitive substance, photosensitive substance consisting of binder and inorganic photoconductor like zinc oxide or cadmium sulfide, various organic photosensitive substances and photosensitive substance having on its surface the light-transmission type insulation layer may be used.

Aforesaid temperatures to be set, $T_1$ and $T_2$ are decided to the most pertinent value from the viewpoint of the type and characteristic of the photosensitive substance to be used.

Following is a description of the example and the present invention is not limited to the example.

EXAMPLE

Figure 5:
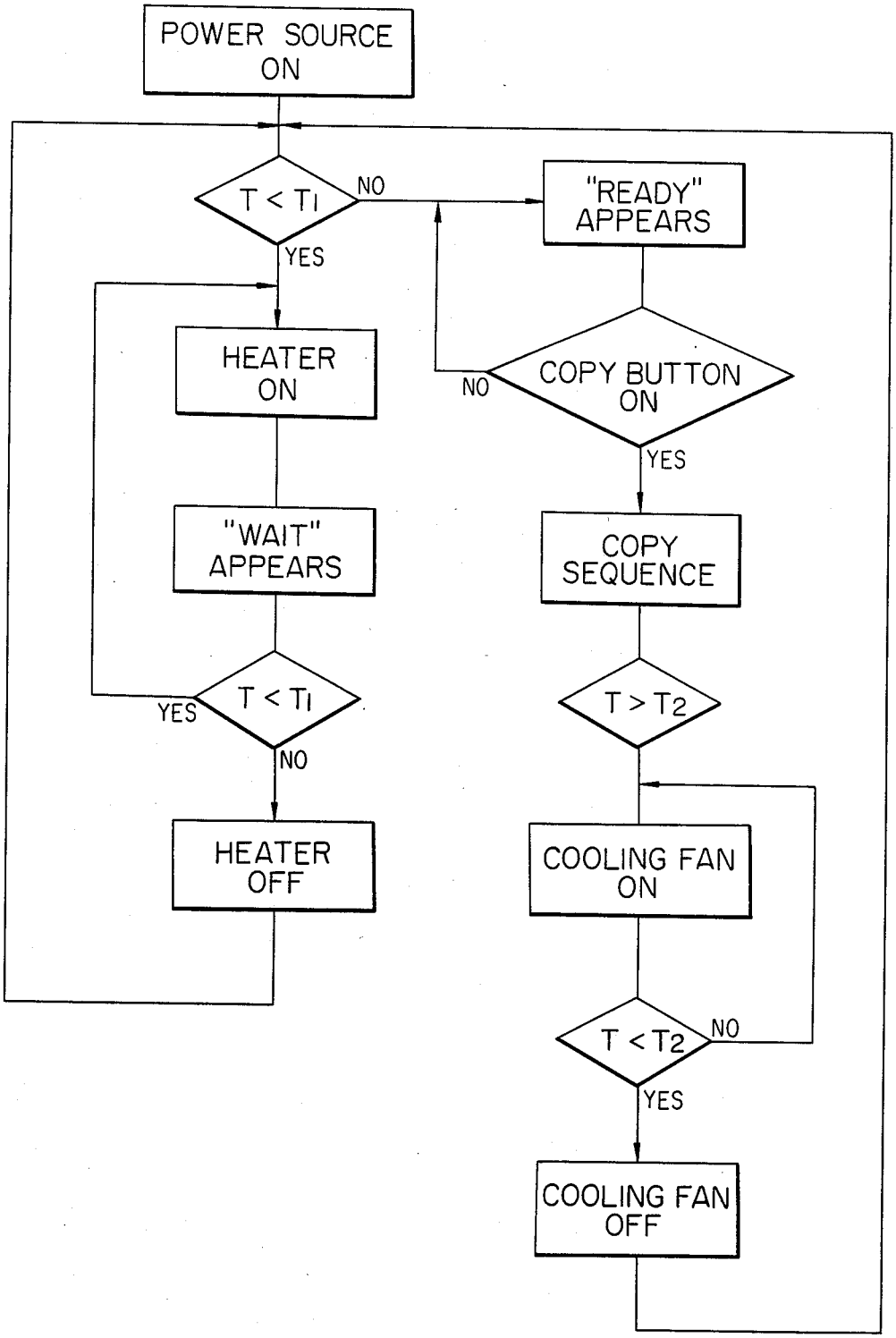
FIG. 5 shows an operation flow diagram of the temperature control system for the photoreceptor of present invention.

An electrostatic copying machine having the constitution of FIG. 1 and a cooling fan for photoreceptor in FIG. 3 was prepared. However, the heater 17 in FIG. 3 is not provided in aforesaid copying machine. FIG. 5 shows an operation flow diagram of the temperature control system for the photoreceptor in aforesaid copying machine. After the power is supplied, the heater 12 keeps operating to heat the photoreceptor until the time when the temperature T of the photoreceptor reaches $T_1$ which is the temperature set at the lower side. During this period, the indication of "WAIT" is lit on the control board. When the temperature T of the photoreceptor reaches the set temperature $T_1$, the power source for the heater 12 is cut and the indication of "READY" is lit. Copying is started and the temperature of the photosensitive substance rises owing to the heat of the intermediate transfer roller 5 and when it reaches $T_2$, the fan 15 starts rotating and cools the photoreceptor and it stops when the temperature T of the photoreceptor becomes lower than $T_2$ which is the temperature set at the higher side.

As a photoreceptor, an organic photosensitive substance was used. With $T_1$ and $T_2$ set at 30° C. and 50° C. respectively, 500 copies were made continuously and there were obtained satisfactory copies wherein the difference was hardly observed on the copies from the first one up to the 500th one. For the purpose of comparison, the copying machine of the same type that does not have aforesaid temperature adjusting device for the photoreceptor was used and copying test which is the same as the foregoing was made but remarkable grey background took place on the copies in the early step of the test and image density dropped on the copies on the second half of the test, both of them were practically unsuitable and thus the effectiveness of the present invention was proved.

Figure 6:
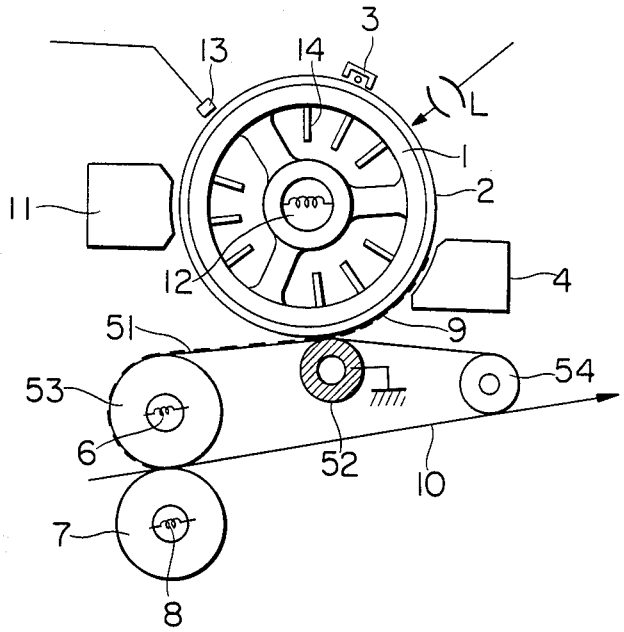
FIG. 6 shows an other example of present invention.

As the case of other example of present invention, a recording apparatus using a belt type intermediate transfer substance is shown in FIG. 6. Numeral 51 indicates a belt type intermediate transfer substance, numeral 52 indicates roller which comes into pressure contact with inner surface of the intermediate transfer belt 51 and outer surface of the intermediate transfer belt 52 is come into pressure contact with the photoreceptor 2. The intermediate transfer belt 51 is arranged so as to rotate counter-clockwise, suspending between rollers 52, 53, 54. The belt 51 is driven syncronizing with the rotation of the photoreceptor 2.

Recording material 10 is fed into the part of pressure contact between intermediate transfer belt 51 and roller 7 having a heater. Toner image on the surface of the intermediate transfer belt 51 is transferred and fixed on recording material 10. In this case, intermediate transfer belt 51 always comes into contact with the photoreceptor 2. This belt 51 is supplied heat from roller 53 or roller 7. Thus photoreceptor is heated at the contact point with intermediate transfer belt 51. In order to keep the distribution of the temperature of the photoreceptor 2 flat, this invention is particularly effective for this case. In the other modified construction of present invention, we can use the convective heat of the transferring and fixing rollers for the heating photoreceptor.

What is claimed is:

1. A recording apparatus for electrostatic images comprising a photoreceptor, an intermediate transfer means, a means for keeping toner images transferred onto said intermediate transfer means, means for transferring said images again and fixing them onto a transfer material characterized in that there is provided a means for detecting a temperature of said photoreceptor and means for maintaining the temperature of said photoreceptor within a fixed range of $T_1$ through $T_2$ said means for maintaining being said intermediate transfer means which is heated and in contact with said photoreceptor when the temperature of said photoreceptor being equal or lower than $T_1$ and said intermediate transfer means is separated from said photoreceptor when said temperature is higher than $T_1$.

2. The recording apparatus for electrostatic images as claimed in claim 1, wherein said means for keeping the temperature of the photoreceptor within a fixed range of $T_1$ through $T_2$ comprises a means for heating aforesaid photoreceptor up to $T_1$ and a means for cooling said photoreceptor down to $T_2$ or less.

3. The recording apparatus for electrostatic images as claimed in claim 1, wherein aforesaid heating means operates when the temperature of the photoreceptor detected by aforesaid temperature detecting means is not more than $T_1$ and stops operating when said temperature is not less than $T_2$.

4. The recording apparatus for electrostatic images as claimed in claim 3, wherein aforesaid heater is provided in the rotary shaft of the drum having on its surface aforesaid photoreceptor.

5. The recording apparatus for electrostatic images as claimed in claim 4, wherein radiator fins are provided on inner surface of aforesaid drum.

6. The recording apparatus for electrostatic images as claimed in claim 1, wherein a cooling means for lowering the temperature of aforesaid photoreceptor down to $T_2$ or lower than that is a blower or a fan that is constituted so that it operates when the temperature detected by aforesaid temperature detecting means is higher than $T_2$ and it stops operating when said temperature is lower than $T_1$.

* * * * *